US010433061B2

(12) United States Patent
Na et al.

(10) Patent No.: US 10,433,061 B2
(45) Date of Patent: Oct. 1, 2019

(54) EAR UNIT AND PORTABLE SOUND DEVICE

(71) Applicant: LG ELECTRONICS INC., Seoul (KR)

(72) Inventors: Yonghyuk Na, Seoul (KR); Jungyoun Kang, Seoul (KR); Jaeyoung Lee, Seoul (KR); Taehoon Yoo, Seoul (KR); Shin Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/854,049

(22) Filed: Dec. 26, 2017

(65) Prior Publication Data

US 2018/0184205 A1 Jun. 28, 2018

(30) Foreign Application Priority Data

Dec. 26, 2016 (KR) ..... 10-2016-0179178

(51) Int. Cl.

*H04R 5/033* (2006.01)
*H04R 1/10* (2006.01)
*H04R 1/28* (2006.01)

(52) U.S. Cl.

CPC ..... *H04R 5/0335* (2013.01); *H04R 1/1008* (2013.01); *H04R 1/1016* (2013.01); *H04R 1/1083* (2013.01); *H04R 1/2803* (2013.01); *H04R 2420/07* (2013.01)

(58) Field of Classification Search

CPC .. H04R 5/0335; H04R 1/1083; H04R 1/1008; H04R 1/10; H04R 1/28; H04R 1/12; H04R 1/2803; H04R 1/1016; H04R 5/033

See application file for complete search history.

(56) References Cited

U.S. PATENT DOCUMENTS 4,972,488 A 11/1990 Weiss et al.
8,265,327 B2 * 9/2012 Ishizaka ..... H04R 1/12 381/324
8,767,995 B2 * 7/2014 Hwang ..... H04R 1/1091 381/370
8,831,266 B1 * 9/2014 Huang ..... H04R 1/1091 381/380
9,055,364 B1 * 6/2015 Uh ..... H04R 5/033
(Continued)

FOREIGN PATENT DOCUMENTS

CN 205213013 U 5/2016
CN 106165442 A 11/2016
(Continued)

*Primary Examiner* — Oyesola C Ojo
(74) *Attorney, Agent, or Firm* — Birch, Stewart, Kolasch & Birch, LLP

(57) ABSTRACT

An ear unit and a portable sound device having the same are provided. The ear unit includes a driver unit, an ear housing configured to form an electric part in which the driver unit is mounted and including a bass hole and a flat hole formed in a first surface of the electric part, a rotator including a second surface opposite the first surface and rotatably coupled to the ear housing, and an opening/closing hole provided in the second surface of the rotator to open or close the bass hole or the flat hole according to rotation of the rotator. The flat hole is connected to an inner hole formed in one position inside the first surface so as to form a duct.

18 Claims, 16 Drawing Sheets

(56) References Cited

U.S. PATENT DOCUMENTS

2003/0081794 A1* 5/2003 Fushimi ..... H04R 1/1016 381/74
2005/0128431 A1* 6/2005 Jannard ..... G02C 11/06 351/158
2007/0189569 A1* 8/2007 Haapapuro ..... H04R 1/1016 381/380
2008/0013773 A1* 1/2008 Yang ..... H04R 1/2826 381/379
2008/0240486 A1 10/2008 Garcia et al.
2009/0103764 A1 4/2009 Stiehl et al.
2010/0331058 A1 12/2010 Qingshan et al.
2011/0031060 A1 2/2011 Epping et al.
2011/0051981 A1* 3/2011 Lehdorfer ..... H04R 1/1075 381/380
2012/0020501 A1 1/2012 Lee
2012/0051574 A1* 3/2012 Lin ..... H04R 1/2803 381/353
2012/0093332 A1* 4/2012 Lin ..... H04R 1/1091 381/71.6
2012/0321103 A1* 12/2012 Smailagic ..... H04R 1/1041 381/98
2013/0163804 A1* 6/2013 Hwang ..... H04R 1/1091 381/380
2013/0188801 A1 7/2013 Ambrose et al.
2013/0259287 A1* 10/2013 Tseng ..... H04R 1/1016 381/380
2014/0119555 A1* 5/2014 Lu ..... H04R 25/554 381/74
2015/0256921 A1* 9/2015 Martin ..... H04R 1/1016 381/380
2015/0264474 A1* 9/2015 Seo ..... G06F 3/165 381/74
2015/0382095 A1* 12/2015 Shin ..... H04R 1/1033 242/385.4
2016/0066081 A1* 3/2016 Annunziato ..... H04R 1/1016 381/380
2016/0269839 A1* 9/2016 Meyer ..... H04R 25/654
2016/0337747 A1* 11/2016 Litovsky ..... H04R 5/0335

FOREIGN PATENT DOCUMENTS

EP 2306755 A1 4/2011
EP 2480007 A1 7/2012
EP 2822293 A2 1/2015
JP 4966201 B2 7/2012
KR 10-0962169 B1 6/2010
KR 10-2010-0108871 A 10/2010
KR 10-2011-0125346 A 11/2011
KR 20110125346 A * 11/2011 ..... H04R 1/10
KR 10-1479964 B1 1/2015
KR 10-1673414 B1 11/2016
KR 10-2016-0147687 A 12/2016
WO WO 2009/104833 A1 8/2009
WO WO-2009104833 A1 * 8/2009 ..... H04R 1/1041

* cited by examiner

EAR UNIT AND PORTABLE SOUND DEVICE

This application claims the benefit of Korean Patent Application No. 10-2016-0179178, filed on Dec. 26, 2016, which is hereby incorporated by reference as if fully set forth herein.

BACKGROUND OF THE INVENTION

Field of the Invention

The present invention relates to an ear unit, which outputs a sound signal, and a portable sound device, which transmits and receives a sound signal to and from a terminal via wired or wireless communication and transmits a control signal to control the terminal in response to a signal input via a user input unit.

Discussion of the Related Art

A sound device refers to a device that receives a sound signal from a terminal and transmits sound information, collected via a microphone, to the terminal. Although a wired-type portable sound device in which a jack thereof is fitted to an earphone port of a terminal to receive a sound signal has conventionally been used, demand for wireless-communication-type portable sound devices has recently increased in terms of mobility and use convenience.

Portable sound devices designed in consideration of portability have been developed to allow a user to carry the device on the body, such as a headphone-type device fitted around the head in a band shape or an earphone-type device hanging on or inserted into the ear.

In particular, recently, use of a portable sound device having a neck-band shape that the user can hang around the neck has increased.

Such a portable sound device having a neck-band shape includes an ear unit, which is directly worn on the user's ear. The ear unit may be seated and stored in a neck-band housing of the portable sound device having a neck-band shape when it is not in use.

For this reason, the ear unit may need to have a small size and a light weight.

In addition, since users have become more interested in sound quality, there is demand for adjusting or improving the sound quality of the ear unit.

SUMMARY OF THE INVENTION

Accordingly, the present invention is directed to an ear unit and a portable sound device that substantially obviate one or more in problems due to limitations and disadvantages of the related art.

An object of the present invention devised to solve the problem lies on a portable sound device having enhanced usability such as improved sound quality.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, there is provided an ear unit including a driver unit, an ear housing configured to form an electric part in which the driver unit is mounted and including a bass hole and a flat hole formed in a first surface of the electric part, a rotator including a second surface opposite the first surface and rotatably coupled to the ear housing, and an opening/closing hole provided in the second surface of the rotator to open or close the bass hole or the flat hole according to rotation of the rotator, wherein the flat hole is connected to an inner hole formed in one position inside the first surface so as to form a duct.

In addition, the ear unit may further include a sealing gasket provided between the first surface and the second surface and including connection holes respectively corresponding to the bass hole and the flat hole.

In addition, the ear housing may further include a coupling flange configured to define a circular opening, and the rotator may further include a rotating hook portion fastened to the coupling flange so as to rotate along an inner circumferential surface of the coupling flange inside the opening.

In addition, the rotating hook portion may include a plurality of hook protrusions provided along the inner circumferential surface of the coupling flange inside the opening, and a rubber support element fitted between the hook protrusions to open the hook protrusions.

In addition, the ear unit may further include a guide portion provided between the ear housing and the rotator to limit a rotation angle of the rotator, the opening/closing hole may open an overall area of the bass hole in a first state in which the rotator is rotated to one end of the rotation angle, and the opening/closing hole may open an overall area of the flat hole in a second state in which the rotator is rotated to a remaining end of the rotation angle.

In addition, the rotator may be rotated to a third state in which the opening/closing hole opens a partial area of the bass hole and a partial area of the flat hole at the same time.

In addition, the ear housing may further include a hole plate configured to form an outer side of the first surface, a damper layer coupled to an inner surface of the hole plate and including therein the inner hole, and a duct groove formed in the inner surface of the hole plate so as to connect the inner hole and the flat hole to each other.

In accordance with another aspect of the present invention, provided herein is a portable sound device including an ear unit including an ear housing, in which a driver unit is mounted, and a rotator coupled to a rear surface of the ear housing and configured to rotate, an ear unit wire including one end coupled to a side surface of the ear housing, a neck-band housing configured to form an electric part in a first direction and to allow the ear unit wire to be introduced thereinto or discharged therefrom, and a seating portion including a seating surface formed so as to be tilted relative to the first direction by a particular angle and a through-hole configured to allow the ear unit wire to penetrate, the seating portion being coupled to an end of the neck-band housing, wherein the ear unit includes a rear surface configured to be seated on the seating portion, and the seating portion surrounds an entire upper portion of the ear unit.

In addition, the seating surface may be formed on a first area of the seating portion, the through-hole may be formed in a second area of the seating portion, and the first area and the second area may be spaced apart from each other.

In addition, the end of the neck-band housing may form an open area, and the seating portion may further include a seating bracket inserted into and coupled to the open area in the neck-band housing.

In addition, the seating bracket may include a support portion configured to support an upper surface, a lower surface, and one side surface of the neck-band housing inside the open area, and a support hole formed in an area of the support portion so that a coupling boss penetrates therethrough to couple an upper portion and a lower portion of the neck-band housing to each other.

In addition, the portable sound device may further include a conducting wire configured to electrically interconnect opposite neck-band housings, a wire bracket configured to support the conducting wire and fastened at one side thereof to each neck-band housing, a wire case configured to surround the wire bracket so as to form an external appearance, and a first screw hole configured to enable fastening between the wire case and the wire bracket, wherein the first screw hole is provided in each of three positions including one end, a middle end, and a remaining end of the wire bracket.

In addition, the portable sound device may further include a wire seating groove formed in the wire bracket so that the conducting wire is seated therein, and the seating groove may include an area corresponding to the first screw hole and having a bent shape so as to deviate to one side.

In addition, the wire case may include an inner wire case configured to surround one surface of the wire bracket, an outer wire case coupled to the inner wire case and configured to surround a remaining surface of the wire bracket, and the first screw hole formed in the inner wire case in a second direction, the neck-band housing may include an upper neck-band housing, a lower neck-band housing coupled to the upper neck-band housing, and a second screw hole formed in the lower neck-band housing in a third direction, the second direction and the third direction may be different directions, the outer wire case and the upper neck-band housing may be integrally manufactured, and the inner wire case and the lower neck-band housing may be manufactured separately.

In addition, the portable sound device may further include an elastic wire portion including opposite ends each connected to the wire bracket, the elastic wire portion being configured to form a continuous surface along with the wire case so as to define an external appearance, and a boundary between the elastic wire portion and the wire case may include a curved area in an arbitrary direction.

In addition, the boundary between the elastic wire portion and the wire case may have an S-shaped form.

In addition, the portable sound device may further include a first magnetic element provided inside the seating surface, and a second magnetic element configured to generate magnetic attraction with the first magnetic element and provided on a rotation center axis of the rotator.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Figure 1:
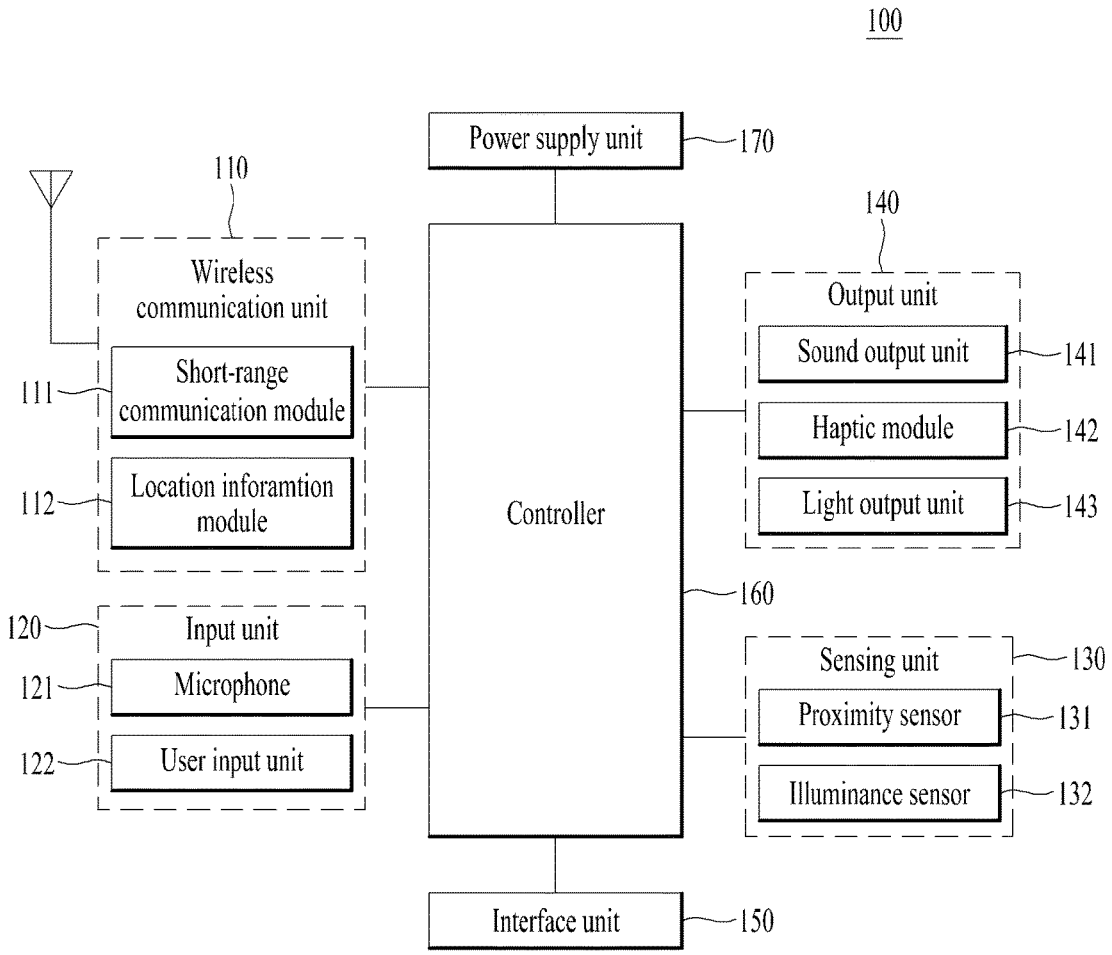
FIG. 1 is a block diagram for explaining a portable sound device according to the present invention.

Hereinafter, embodiments disclosed in this specification will be described in detail with reference to the accompanying drawings. In the drawings, the same or similar elements are denoted by the same reference numerals even though they are depicted in different drawings, and a repeated description thereof is omitted. With respect to constituent elements used in the following description, suffixes "module" and "unit" are given or mingled with each other only in consideration of ease in the preparation of the specification, and do not have or serve as different meanings. In the following description of the present invention, a detailed description of known functions and configurations incorporated herein will be omitted when it may make the subject matter of the embodiments disclosed in this specification rather unclear. In addition, it is to be understood that the accompanying drawings are intended to assist easy understanding of the embodiments disclosed in this specification and are not intended to limit the technical spirit disclosed in this specification. Therefore, it should be understood that the accompanying drawings include all of various equivalents, modifications and substitutions, which are included in the spirit and technical scope of the present invention.

A sound device refers to a device that receives a sound signal from a terminal and transmits sound information, collected via a microphone, to the terminal. Although a wired-type portable sound device in which a jack thereof is fitted to an earphone port of a terminal to receive a sound signal has conventionally been used, demand for wireless-communication-type portable sound devices has recently increased in terms of mobility and use convenience.

Portable sound devices designed in consideration of portability have been developed to allow a user to carry the device on the body, such as a headphone-type device fitted around the head in a band shape or an earphone-type device hanging on or inserted into the ear.

In particular, recently, use of a portable sound device having a neck-band shape that the user can hang around the neck has increased.

Such a portable sound device having a neck-band shape includes an ear unit, which is directly worn on the user's ear. The ear unit may be seated and stored in a neck-band housing of the portable sound device having a neck-band shape when it is not in use.

For this reason, the ear unit may need to have a small size and a light weight.

In addition, since users have become more interested in sound quality, there is demand for adjusting or improving the sound quality of the ear unit.

FIG. 1 is a block diagram for explaining a portable sound device 100 according to the present invention.

The portable sound device 100 may include, for example, a wireless communication unit 110, an input unit 120, a sensing unit 130, an output unit 140, an interface unit 150, a controller 160, and a power supply unit 170.

The constituent elements illustrated in FIG. 1 may not be necessary to realize the portable sound device 100, and thus the portable sound device 100 described in this specification may have a greater or smaller number of constituent elements than the constituent elements enumerated above.

More specifically, among the aforementioned constituent elements, the wireless communication unit 110 may include one or more modules, which enable wireless communication between the portable sound device 100 and a wireless communication system, between the portable sound device 100 and another mobile terminal, or between the portable sound device 100 and an external server. In addition, the wireless communication unit 110 may include one or more modules, which connect the portable sound device 100 to one or more networks.

The wireless communication unit 110 may include at least one of a short-range communication module 111 or a location information module 112. Alternatively, the wireless communication unit 110 may include, for example, a mobile communication module or a wireless Internet module as needed.

The short-range communication module 111 is used for short-range communication, and may support short-range communication using at least one of BLUETOOTH™, Radio Frequency Identification (RFID), Infrared Data Association (IrDA), Ultra-Wideband (UWB), ZigBee, Near Field Communication (NFC), Wireless Fidelity (Wi-Fi), Wi-Fi Direct, or Wireless Universal Serial Bus (Wireless USB).

The short-range communication module 111 may support wireless communication between the portable sound device 100 and a wireless communication system, between the portable sound device 100 and another mobile terminal, or between the portable sound device 100 and a network in which another mobile terminal (or an external server) is located using a short-range wireless communication network. The short-range wireless communication network may be a short-range wireless personal area network.

The short-range communication module 111 may sense (or recognize), for example, a terminal that can perform communication near the portable sound device 100. In addition, when a sensed terminal is a device that is authorized to communicate with the portable sound device 100 according to the present invention, the controller 160 may receive at least some of the data processed in the mobile terminal via the short-range communication module 111. Thus, the user of the portable sound device 100 may use the data processed in the terminal via a wearable device.

For example, when a call is received by, for example, a terminal, the user may engage in a telephone conversation using the portable sound device 100.

The location information module 112 is a module for acquiring the location (or the current location) of the portable sound device 100, and a representative example thereof may be a global positioning system (GPS) module or a wireless fidelity (Wi-Fi) module. For example, when the portable sound device 100 uses the GPS module, the mobile terminal may acquire the location of the portable sound device 100 using a signal transmitted from a GPS satellite. In another example, when the portable sound device 100 uses a Wi-Fi module, the mobile terminal may acquire the location of the portable sound device 100 based on information from a wireless access point (AP), which transmits or receives a wireless signal to or from the Wi-Fi module. As needed, the location information module 112 may perform the function of any other modules of the wireless communication unit 110 so as to replace the corresponding module or to be additionally used along with the corresponding module, in order to obtain data regarding the location of the portable sound device 100. The location information module 112 is a module used for acquiring the location (or the current location) of the portable sound device 100, and is not limited to a module that directly calculates or acquires the location of the portable sound device 100.

The input unit 120 may include, for example, a microphone (MIC) 121 or an audio input unit for the input of an audio signal, and a user input unit 122 for receiving information from a user (e.g. a touch key or a push key). Voice data or image data collected by the input unit 120 may be analyzed and may be processed in response to a user control command.

The user input unit 122 is configured to allow the user to control the portable sound device 100. Examples of the user input unit 122 may include a call button, a button for, for example, volume adjustment, a power button, and a storage button for storing a sound cable into a main body.

The user input unit 122 may include only a call button and a pair of volume adjustment buttons, and may further include a play/stop button and a music order change button.

Since the size of the portable sound device 100 is limited, and in many cases, the user performs input without viewing the user input unit 122, provision of a large number of buttons may make it difficult to distinguish the functions of the buttons from each other. Thus, a limited number of buttons may be used in a manner such that the number of inputtable control commands may be increased by combining the time for which each of a plurality of buttons is pushed with the number of times the button is pushed.

The microphone 121 converts an external sound signal into electrical voice data. The converted voice data may be utilized depending on the function that is being performed by the portable sound device 100 (or an application that is being executed), or may be transmitted to an external terminal or an external server via the wireless communication unit 110. Meanwhile, various noise removal algorithms may be realized in the microphone 122 in order to remove noise generated in the process of receiving an external sound signal.

The sensing unit 130 may include one or more sensors for sensing at least one of information on the interior of the portable sound device 100, information on the environment surrounding the portable sound device 100, or user information. For example, the sensing unit 130 may include at least one of a proximity sensor 131, an illumination sensor 132, a touch sensor, an acceleration sensor, a magnetic sensor, a G-sensor, a gyroscope sensor, a motion sensor, an RGB sensor, an infrared (IR) sensor, a finger scan sensor, an ultrasonic sensor, an optical sensor, a microphone (see reference numeral 121), a battery gauge, an environmental sensor (e.g., a barometer, a hygrometer, a thermometer, a radiation sensor, a thermal sensor, or a gas sensor), or a chemical sensor (e.g. an e-nose, a healthcare sensor, or a biometric sensor). Meanwhile, the portable sound device 100 disclosed in this specification may combine and utilize information sensed by at least two or more sensors among the aforementioned sensors.

In particular, a sensor, which senses whether or not an earphone to be described later is located on a holder, may be provided. As a representative example of such a sensor, a magnetic sensor may be used.

The output unit 140 serves to generate, for example, visual output, acoustic output, or haptic output. The output unit 140 may include at least one of a sound output unit 141, a haptic module 142, or a light output unit 143.

The sound output unit 142 is a device that outputs sound in response to a sound signal. A representative example of the sound output unit 142 may include an earphone, which transmits sound while being worn on the user's ear, and a speaker, which outputs sound in the state in which the user is not wearing the earphone.

The interface unit 150 serves as a path to various types of external devices connected to the portable sound device 100. The interface unit 150 may include at least one of an external charger port, or a wired/wireless data port. When an external device is connected to the interface unit 150, the portable sound device 100 may perform appropriate control related to the connected external device.

The controller 160 typically controls the overall operation of the portable sound device 100, in addition to operations related to the application. The controller 160 may process, for example, signals, data, and information input to or output from the constituent elements described above.

The power supply unit 170 receives external power or internal power under the control of the controller 160 and supplies the power to the respective constituent elements included in the portable sound device 100. The power supply unit 170 may include a battery, and the battery may be a built-in battery or a replaceable battery.

At least some of the constituent elements described above may be operated in cooperation with each other in order to realize the operation of the portable sound device 100 or a control method thereof according to various embodiments, which will be described below.

Figure 2:
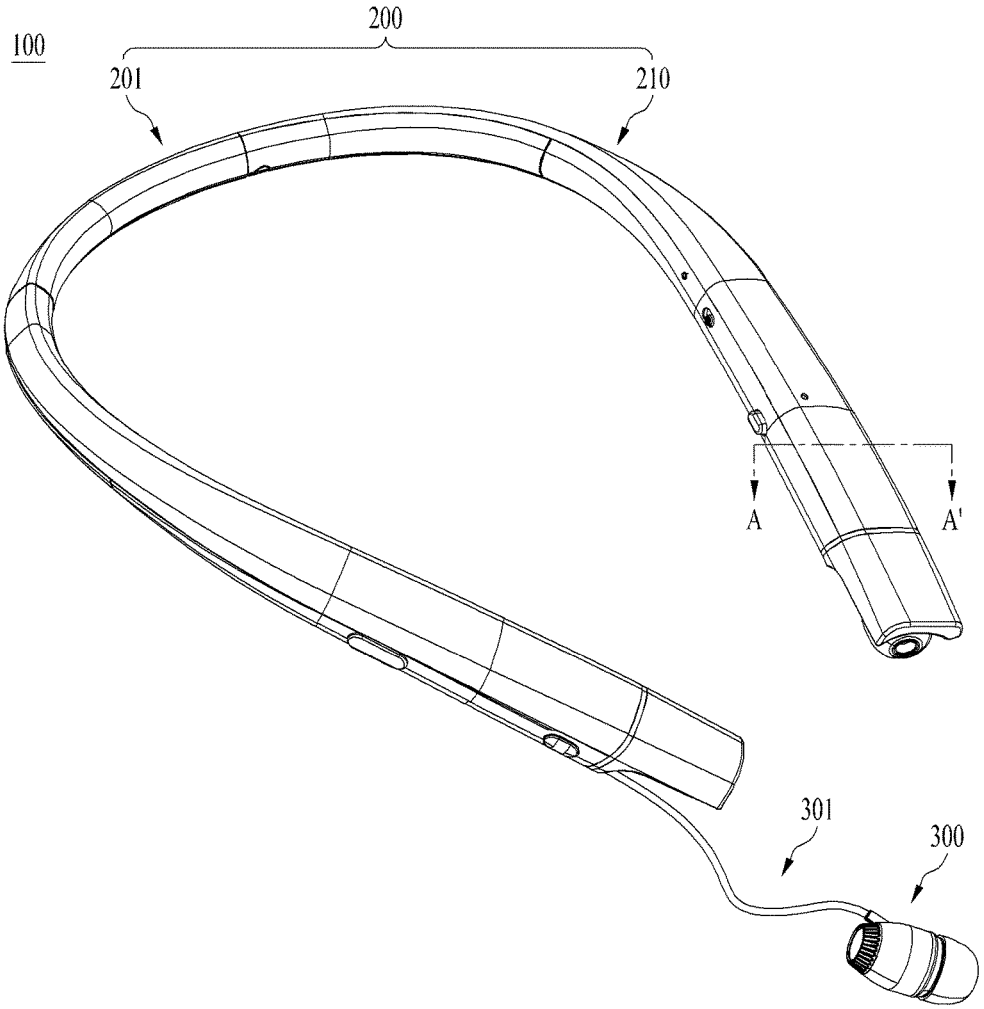
FIG. 2 is a front perspective view of the portable sound device according to the present invention.

FIG. 2 is a front perspective view of the portable sound device 100 according to the present invention.

The portable sound device 100 basically includes neck-band housings 210, which are provided on opposite sides, a wire unit 201, which interconnects both the neck-band housings 210, and an ear unit 300.

The wire unit 201 and the neck-band housings 210 may define a main body 200, and may be used in the state of being seated on the user's neck. The main body 200 may have a U-shaped form having an opening in one side thereof, and may have an ergonomically curved shape.

Each neck-band housing 210 defines an electric part in which major elements, such as a battery and a main board, are mounted.

The ear unit 300 is equipped with a driver unit, which directly outputs sound. The ear unit 300 may be electrically connected to electronic elements of the neck-band housing 210 via an ear unit wire 301.

The ear unit wire 301 may be discharged from the neck-band housing 210 when the ear unit 300 is in use, and may be introduced into the neck-band housing 210 when the ear unit 300 is not in use. When in use, the ear unit 300 may be separated from a seating portion of the neck-band housing 210 and may be worn on the user's ear. When not in use, a rear portion of the ear unit 300 may be seated and stored in the seating portion of the neck-band housing 210.

The ear unit 300 of the present invention may output sound by changing the quality of sound depending on user selection. Hereinafter, this feature will be described.

Figure 3:
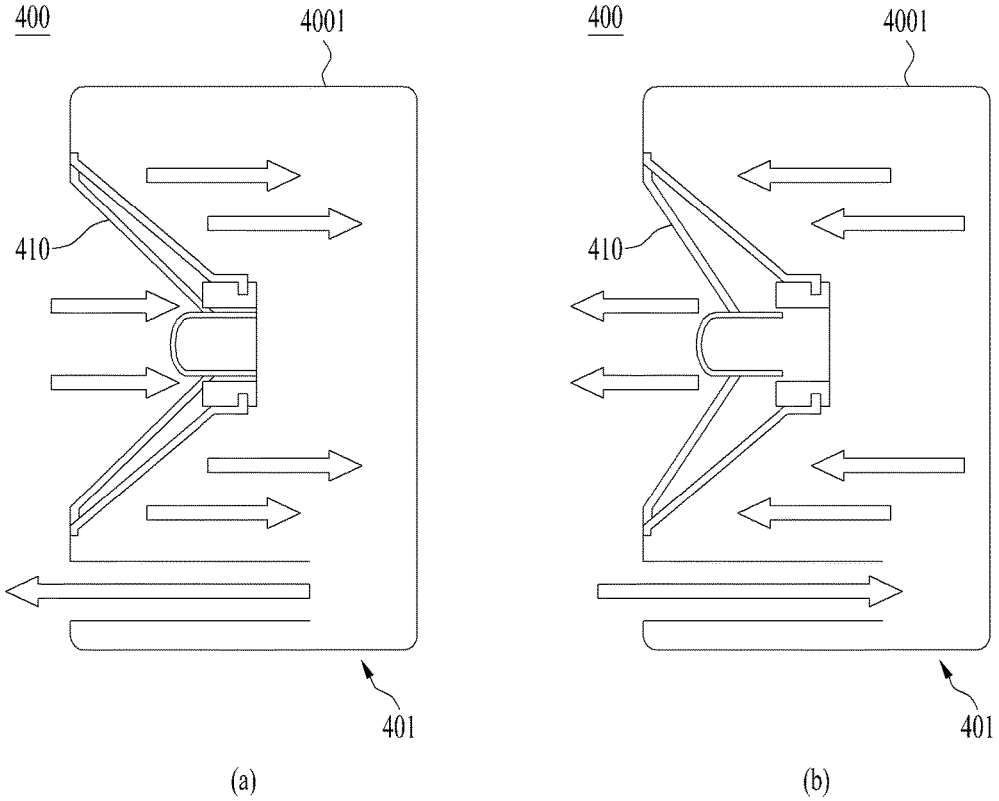
FIG. 3 is a schematic cross-sectional view illustrating a driver unit of an ear unit according to the present invention.

FIG. 3 is a schematic cross-sectional view illustrating a driver unit 401 of an ear unit 300 according to the present invention.

With regard to physical characteristics of the ear unit 400, the degree of output of sound within a specific range may act as a variable helping determine the amount of ventilation of a receiver.

That is, in a housing 4001 of the ear unit 400 in which the driver unit 401 is mounted, the output of sound within a specific range may be adjusted by varying the amount of air introduced into or discharged from the housing 4001.

When a vibrating plate 410 of the driver unit 401 is compressed as illustrated in FIG. 3(*a*), the inside of the driver unit 401 is compressed, causing air to be discharged outward. When the vibrating plate 410 of the driver unit 401 expands as illustrated in FIG. 3(*b*), the inside of the driver unit 401 expands, causing outside air to be introduced.

Sound is generated via the vibration process in which the vibrating plate 410 repeats compression and expansion as illustrated in FIGS. 3(*a*) and 3(*b*).

The output in a specific frequency band may increase as the vibration displacement of the vibrating plate 410 increases, and the output in a specific frequency band may decrease as the vibration displacement of the vibrating plate 410 decreases.

The vibration displacement of the vibrating plate 410 may be adjusted according to the amount of air that is introduced into or discharged from the driver unit 401.

In the state in which a large amount of air is introduced into or discharged from the driver unit 401, i.e. in the state in which the amount of ventilation is high, a relatively low pressure may be applied to the driver unit 401, and thus the vibration displacement of the vibrating plate 410 may be increased, which may increase the output of sound within a specific range.

Conversely, in the state in which a small amount of air is introduced into or discharged from the driver unit 401, i.e. in the state in which the amount of ventilation is low, a relatively high pressure may be applied to the driver unit 401, and thus the vibration displacement of the vibrating plate 410 may not be increased, which may decrease the output of sound within a specific range.

Figure 4:
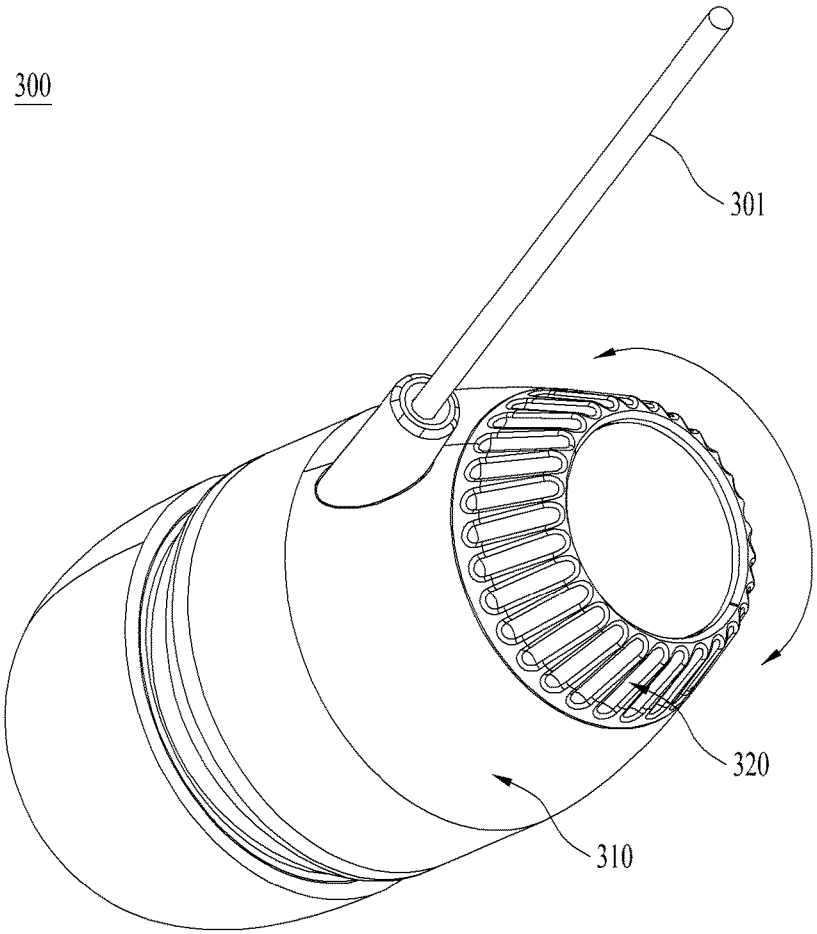
FIG. 4 is a perspective view of the ear unit according to the present invention.

FIG. 4 is a perspective view of the ear unit 300 according to the present invention.

A function of adjusting relative tone by adjusting the output of sound at a specific frequency or within a specific frequency band is referred to as "equalizing". For example, treble boost may be realized when the output in a low frequency band is reduced to thus increase the relative output in a high frequency band, or bass boost may be realized by increasing the output in a low frequency band to thus increase resonance thereof.

The equalizing function may be of a software type, in which a signal of a sound source to be output is processed or modulated, or of a hardware type, in which tone is adjusted by changing the physical properties of hardware.

The present invention proposes a hardware-type equalizing method.

The ear unit 300 includes an ear housing 310 and a rotator 320. The rotator 320 may be coupled to the ear housing 310 so as to be rotated relative to the ear housing 310.

The user may realize first equalizing by rotating the rotator 320 in a given direction, or may realize second equalizing by rotating the rotator 320 in an opposite direction.

For example, the first equalizing may correspond to a bass boost function, and the second equalizing may correspond to a treble boost function.

The rotation angle of the rotator 320 may be continuously changed over 360 degrees, but may be limited in some cases. That is, the rotator 320 may be rotated within a first angular range. When the rotator 320 is rotated to one end of the first angular range, the first equalizing may be performed. When the rotator 320 is rotated to the other end of the first angular range, the second equalizing may be performed.

When the rotator 320 is rotated within the first angular range, the user may reliably recognize whether the first equalizing is performed or the second equalizing is performed.

The concrete structure for allowing the rotator 320 to be rotated within the first angular range will be described later.

Since the size of the ear unit 300 is not large, the rotator 320 may need to be formed so as to ensure easy rotating operation. The rotator 320 may take the form of a disc covering the entire rear surface of the ear housing 310. Since the rotator 320 covers the entire rear surface of the ear housing 310, the user may easily rotate the rotator 320 by gripping the ear housing 310 with one hand and gripping the rotator 320 with the other hand.

In addition, the rotator 320 may be provided on the outer circumferential surface thereof with a pattern for increasing frictional force. When frictional force is high, slippage of the hand upon rotation of the rotator 320 may be prevented.

Figure 5:
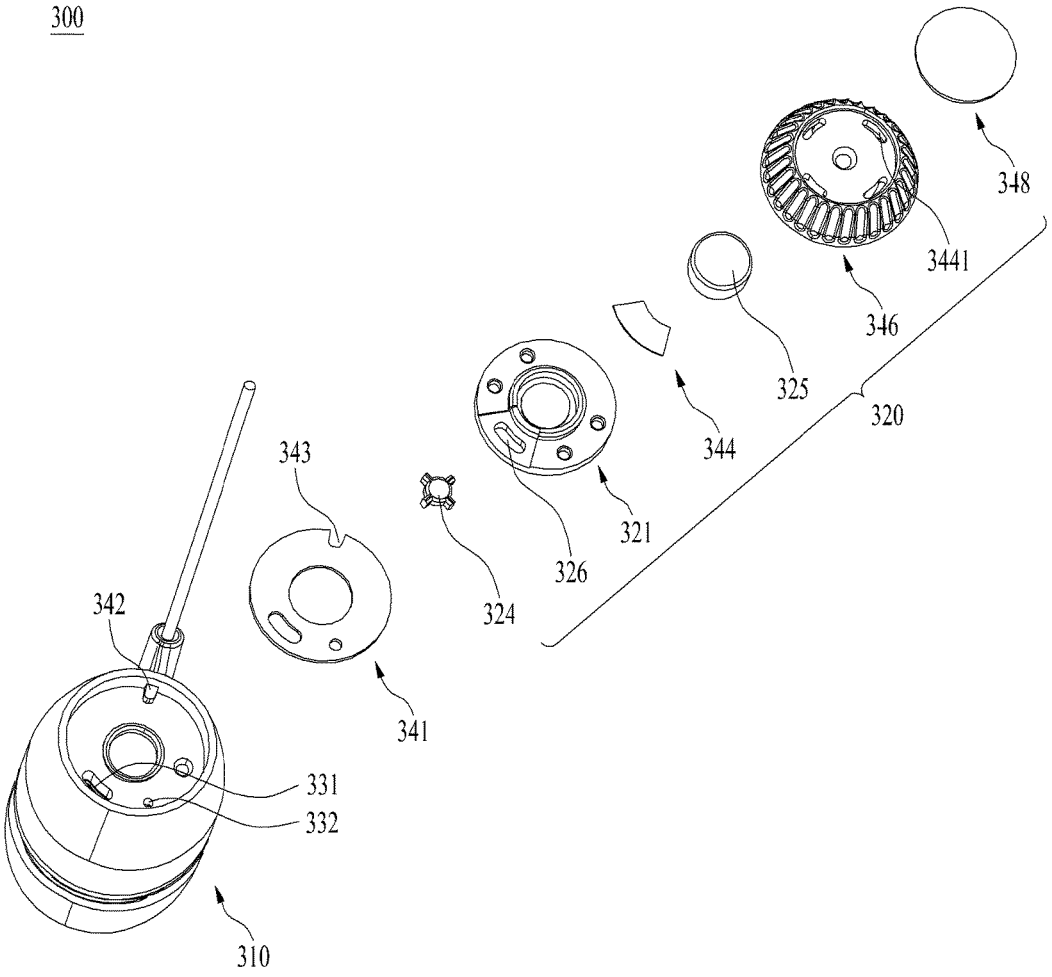
FIG. 5 is a partial exploded perspective view of the ear unit according to the present invention.

FIG. 5 is a partial exploded perspective view of the ear unit 300 according to the present invention.

The ear housing 310 may have a bass hole 331 and a flat hole 332. In particular, the bass hole 331 and the flat hole 332 may be provided in a first surface of the ear housing 310, and the first surface may be the rear surface of the ear housing 310.

Through the provision of these holes in the rear surface, equalizing may be performed based on the rotation of the rotator 320, which is coupled to the rear surface.

The rotator 320 has an opening/closing hole 326. The opening/closing hole 326 may open or close the bass hole 331 or the flat hole 332 according to the rotation of the rotator 320, thereby performing different equalizing functions. When the opening/closing hole 326 opens the bass hole 331, bass boost equalizing may be performed. When the opening/closing hole 326 opens the flat hole 332, treble boost equalizing may be performed.

Treble boost and bass boost merely refer to some embodiments of equalizing modes, and equalizing characteristics may be changed according to the shape and size of the aforementioned holes.

The opening/closing hole 326 may be provided in a second surface of the rotator 320. The second surface means the surface that is opposite the first surface of the ear housing 310. The second surface may be realized by an inner bracket 321 of the rotator 320.

The inner bracket 321 may serve not only to enable direct attachment to the ear housing 310, but also to guide rotation of the rotator 320. A detailed description will follow.

The bass hole 331 and the flat hole 332 have different amounts of ventilation with respect to an enclosure of the ear housing 310. The bass hole 331 has an area larger than the flat hole 332 and thus provides a larger amount of ventilation than the flat hole 332. The flat hole 332 has an area smaller than the bass hole 331 and provides a smaller amount of ventilation than the bass hole 331 due to a duct structure thereof, which will be described later.

In general, the smaller the amount of ventilation, the more the bass boost characteristics may be reduced. This may be achieved by reducing the size of a hole, but an unlimited reduction in the diameter of a hole is impossible in terms of hole processing. Thus, a duct structure may be realized to adjust the amount of ventilation.

Figure 6:
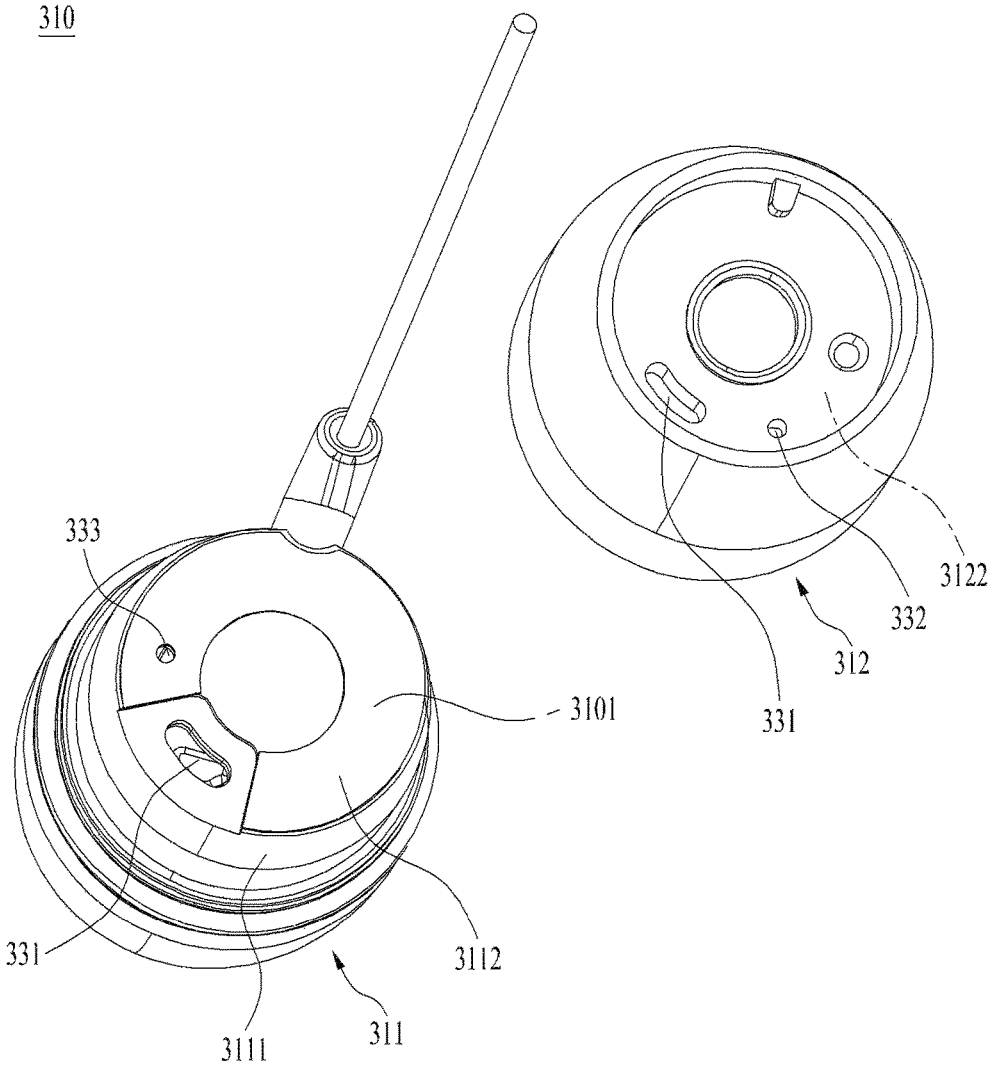
FIG. 6 is a partial exploded perspective view of the ear unit according to the present invention.
Figure 7:
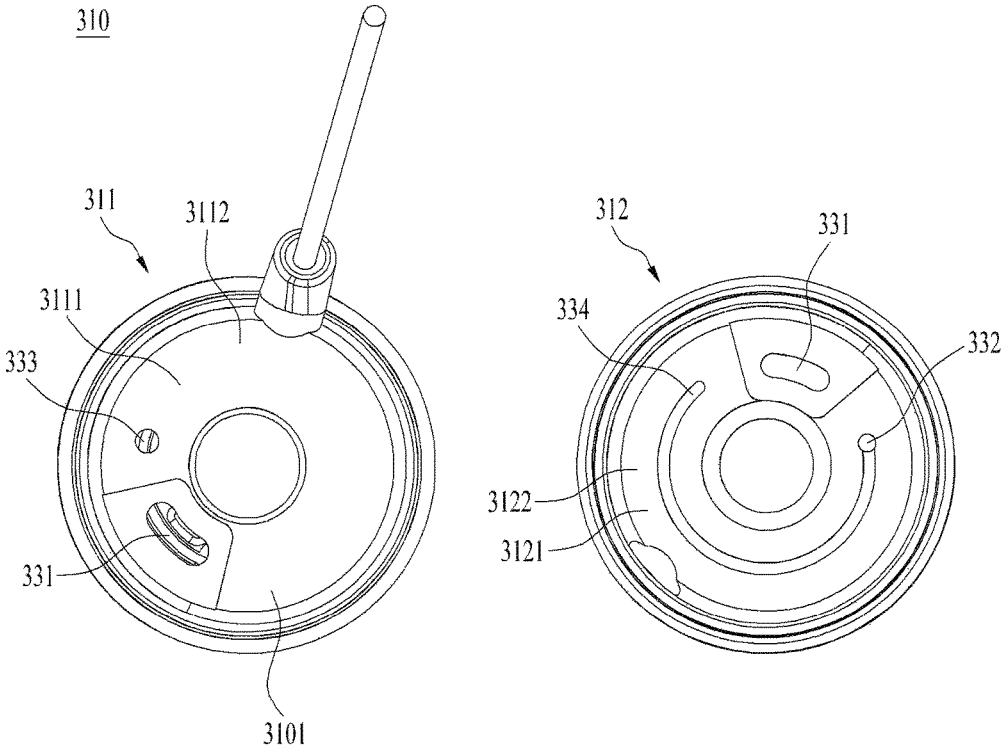
FIG. 7 is a front view illustrating the outer side of an inner case and the inner side of an outer case.

FIG. 6 is a partial exploded perspective view of the ear unit 300 according to the present invention, and FIG. 7 is a front view illustrating the outer side of an inner case 311 and the inner side of an outer case 312. For convenience of description, FIGS. 6 and 7 are described together.

The ear housing 310 may be divided into the inner case 311, which directly defines an electric part 3101 in which elements such as a driver unit 401 is mounted, and the outer case 312, which surrounds and is coupled to an outer surface 3111 of the inner case 311. An inner surface 3121 of the outer case 312 may be coupled to the outer surface 3111 of the inner case 311.

As described above, since the size of the flat hole 332 may not be reduced infinitely, the amount of ventilation may be reduced via the flat hole 332, which is provided in the outer case 312, more particularly, in a hole plate 3122, and an inner hole 333, which is provided in the inner case 311, more particularly, in a damper layer 3112. In other words, the inner hole 333 is in an inner portion of the ear housing 310 beneath the first surface. The hole plate 3122 forms inner surface of the outer case 312, and the damper layer 3112 forms outer surface of the inner case 311. So the hole plate 3122 and the damper layer 3112 face with each other.

The flat hole 332 and the inner hole 333 are not provided at the same location in the state in which the outer case 312 is coupled to the inner case 311. That is, the flat hole 332 and the inner hole 333 communicate with each other through a duct groove 334 formed in the inner surface 3121 of the outer case 312.

The inner surface 3121 of the outer case 312 is sealed by the outer surface 3111 of the inner case 311 with respect to an area thereof excluding the duct groove 334. Thus, air inside the electric part 3101 in which the driver unit 401 is provided, i.e. inside the enclosure, may be discharged outward from the ear housing 310 by passing through the inner hole 333, the duct groove 334, and the flat hole 332 in sequence, or may be introduced along the opposite path.

The duct groove 334 defines a recessed area in the inner surface 3121 of the outer case 312. The duct groove 334 may have a C-shaped form in order to connect the inner hole 333 and the flat hole 332 to each other. However, the duct groove 334 may have any other shape depending on the required duct length.

On the other hand, the bass hole 331 in the inner case 311 and the bass hole 331 in the outer case 312 may be disposed at the same location in the state in which the inner case 311 and the outer case 312 are coupled to each other. That is, the bass hole 331 in the inner case 311 and the bass hole 331 in the outer case 312 do not form different paths. Thus, the air inside the electric part 3101 may be directly introduced into or discharged from the respective bass holes 331 in the inner case 311 and the outer case 312. Thus, the amount of air introduced into or discharged from the enclosure, i.e. the amount of ventilation, may be increased compared to the case in which the air passes through a path including the flat hole 332.

Referring again to FIG. 5, a sealing gasket 341 is provided between the first surface of the ear housing 310 and the second surface of the rotator 320. The sealing gasket 341 prevents the generation of unexpected noise caused when air leaks from an unopened area when the opening/closing hole 326 opens the flat hole 332 or the bass hole 331.

The sealing gasket 341 may have holes, which have the same shape as that of the flat hole 332 and the bass hole 331 and are formed in positions respectively corresponding to the flat hole 332 and the bass hole 331, and may be coupled to the outer side of the first surface of the ear housing 310. In order to prevent movement between the sealing gasket 341 and the ear housing 310, a fixing protrusion 342 may be provided on the outer side of the first surface of the ear housing 310, and a fixing recess 343, which corresponds to the shape of the fixing protrusion 342, may be provided in the sealing gasket 341.

The inner bracket 321 of the rotator 320 is coupled to a rotating dial 346 and rotated along with the same. The opening/closing hole 326 formed in the inner bracket 321 may open or close at least one of the bass hole 331 or the flat hole 332 so that the air inside the enclosure is introduced into or discharged from only one of the two holes 331 and 332.

A first ventilation mesh 344 may be coupled to the opening/closing hole 326 as needed, and may serve to further reduce the amount of ventilation.

The rotating dial 346 may be coupled to the rear surface of the inner bracket 321. The rotating dial 346 may be formed with a pattern on the outer circumferential surface thereof to allow the user to easily grip and rotate the same, in the same manner as the above description.

The rotating dial 346 may have at least one hole 3441, which adjusts the amount of ventilation, and a second ventilation mesh 348, which covers the hole 3441.

Figure 8:
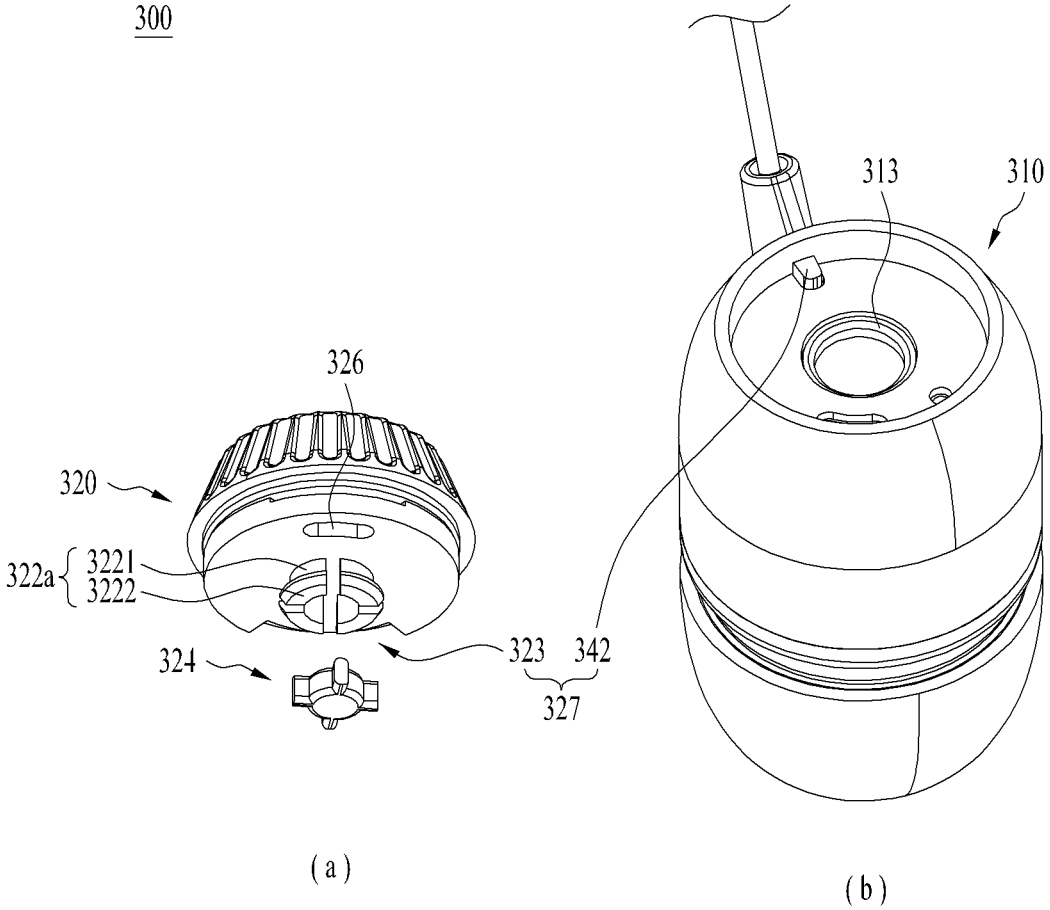
FIG. 8 provides a rear perspective view of a rotator and a front perspective view of an ear housing.
Figure 9:
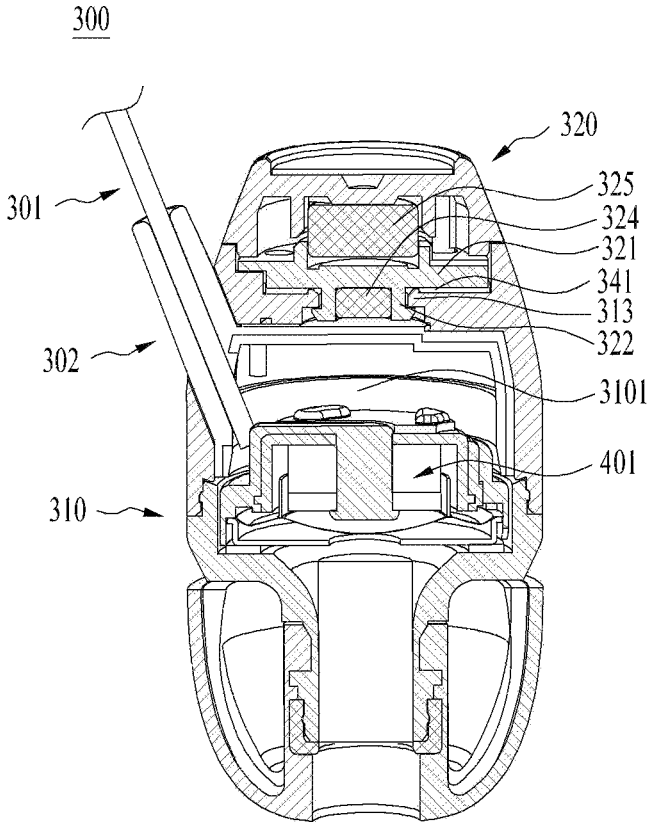
FIG. 9 is a longitudinal cross-sectional view of the ear unit.

FIG. 8 provides a rear perspective view of the rotator 320 and a front perspective view of the ear housing 310 and FIG. 9 is a longitudinal cross-sectional view of the ear unit 300. For convenience of description, FIGS. 8 and 9 are described together.

As described above, the rotator 320 is rotatably coupled to the ear housing 310. The ear housing 310 may include a coupling flange 313, which defines a circular opening. A rotating hook portion 322 of the rotator 320 is fastened, i.e. coupled, to the coupling flange 313 using a hook 3222 so as to be rotated along the inner circumferential surface of the coupling flange 313.

An outer circumferential surface 3221 of the rotating hook portion 322 and the inner circumferential surface of the coupling flange 313 may be engaged with each other to guide the rotation of the rotator 320.

The hook 3222 of the rotating hook portion 322 may be disposed inside the coupling flange 313 and may be located in the inner space defined by the coupling flange 313.

The rotation angle of the rotator 320 may be realized by a guide portion 327, which includes a stepped guide portion 323 of the rotator 320 and the fixing protrusion 342 provided on the first surface of the ear housing 310. The guide portion 327 is provided between the ear housing 310 and the rotator 320 to limit a rotation angle of the rotator 320 between a first position at a first end of the rotation angle and a second position at a second end of the rotation angle.

Opposite boundaries of the stepped guide portion 323 may be caught by the fixing protrusion 342 as the rotator 320 is rotated to one end or the other end of the first angular range, so as to enable the rotation of the rotator 320 within the first angular range.

The rotating hook portion 322 may include a plurality of hook protrusions 322*a*. The plurality of hook protrusion 322*a* extend from the second surface towards the first surface. And the plurality of hook protrusion 322*a* may be spaced about the inner circumferential surface of the circular opening. The hook protrusions 322*a* may be separated from each other and thus, may have elasticity for hook coupling. When the rotator 320 is coupled to the ear housing 310, the hook protrusions 322*a* may be gathered to pass through an opening in the coupling flange 313, and may then be returned and fixed by elastic restoration after the rotator 320 is coupled to the ear housing 310.

However, the rotating hook portion 322 may fail to completely restore the original state thereof due to a manufacturing tolerance or physical deformation depending on the material thereof, whereby the rotator 320 may not be completely fastened to the ear housing 310. This problem may not only simply cause an unwanted gap or movement, but may also have an effect on the amount of ventilation, thereby having an unintended effect on the output of sound.

A rubber support element 324 may be used to outwardly open the hook protrusions 322*a* so as to prevent the hook protrusions 322*a* from being not opened to the original position thereof, or from being insufficiently opened, after being compressed, due to the material physical properties thereof. In other words, the plurality of hook protrusions press the hook protrusions towards the inner circumferential surface of the circular opening. The rubber support element 324 may be formed of an elastic material.

When the hook protrusions 322*a* are sufficiently opened, no gap may be formed between the first surface of the rotator 320 and the second surface of the ear housing 310, which minimizes noises generated in output sound.

In addition, the rubber support element 324 may consequently have the effect of further increasing the force required for the rotation of the rotator 320, thereby allowing the rotator 320 to be rotated only when the user applies sufficient force thereto.

Figure 10:
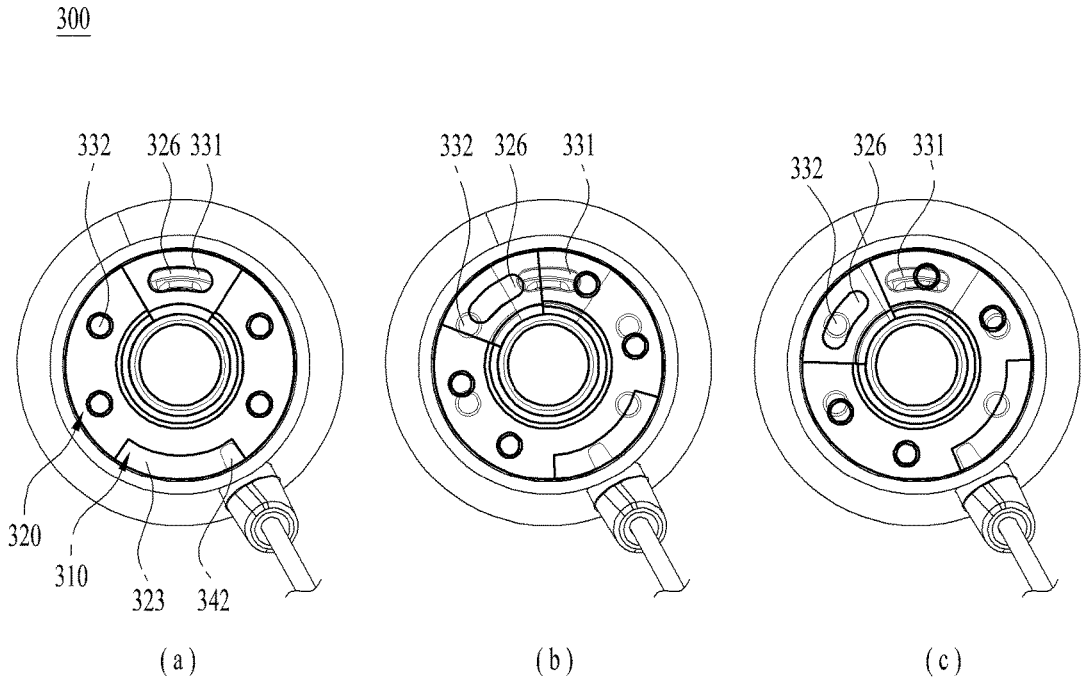
FIG. 10 is a rear view of the ear unit illustrating several states having a difference as to the degree of rotation of the rotator.

FIG. 10 is a rear view of the ear unit 300 illustrating several states having a difference as to the degree of rotation of the rotator 320.

As described above, the rotator 320 may be rotated relative to the ear housing 310 within the first angular range. The first angular range is determined by the widths of the fixing protrusion 342 and the stepped guide portion 323.

FIG. 10(*a*) illustrates a first state in which the rotator 320 rotates to one end within the first angular range, FIG. 10(*c*) illustrates a second state in which the rotator 320 rotates to the other end within the first angular range, and FIG. 10(*b*) illustrates a third state between the states of FIGS. 10(*a*) and 10(*b*).

In the first state of FIG. 10(*a*), the opening/closing hole 326 is located in the first position and opens the bass hole 331 and closes the flat hole 332. It may mean that the rotator 320 is rotated to the first end of the rotation angle. Thus, the electric part 3101 of the ear housing 310, which defines a resonance space, allows the introduction or discharge of air only through the bass hole 331. The shape and size of the opening/closing hole 326 may be equal to or greater than those of the bass hole 331. When the size of the opening/closing hole 326 is equal to or greater than the size of the bass hole 331, the opening/closing hole 326 may prevent the generation of noise in the intended introduction or discharge of air through the bass hole 331.

In the second state of FIG. 10(*c*), the opening/closing hole 326 is located in the second portion and opens the flat hole 332 and closes the bass hole 331. It may mean that the rotator 320 is rotated to the second end of the rotation angle. Thus, the electric part 3101 of the ear housing 310, which defines a resonance space, allows the introduction or discharge of air only through the flat hole 332. The path along which air is introduced into or discharged from the flat hole 332 has been described above, and thus a repeated description thereof will be omitted.

In FIG. 10(*c*), the shape and size of the opening/closing hole 326 may be equal to or greater than those of the flat hole 332. The reason thereof is the same as the above-described reason why the shape and size of the opening/closing hole 326 is equal to or greater than those of the bass hole 331.

In the third state of FIG. 10(*b*), the opening/closing hole 326 is located in the third position between the first position and the second position and may open portions of both the bass hole 331 and the flat hole 332 simultaneously. Specifically, there may not occur the case in which the opening/closing hole 326 completely closes both the entire bass hole 331 and the entire flat hole 332 when the rotator 320 is rotated from the first state to the second state.

The reason for this is that unintended equalizing effects may be caused in the case in which the opening/closing hole 326 closes both the bass hole 331 and the flat hole 332, which may cause the output of undesired sound. Therefore, these characteristics of the arrangement, shape, and size serve to ensure a natural and rapid change from the first state to the second state.

Referring again to FIG. 9, the ear unit wire 301 electrically connects the ear unit 300 and the main body 200 to each other. The ear unit wire 301 is connected to an electronic element of the electric part 3101 of the ear housing 310. The ear unit wire 301 discharged from the ear housing 310 is surrounded at a predetermined distance by a wire support element 302 in order to prevent damage thereto.

A discharged portion of the ear unit wire 301 and the wire support element 302 are provided on the side surface of the ear housing 310. This is because they need to be designed so as to avoid the rotator 320 in consideration of rotation of the rotator 320.

When the ear unit wire 301 is discharged from the side surface of the ear housing 310, the space occupied by the entire ear unit 300 in the width direction is increased. This has an effect on the case in which the ear unit 300 is seated in the main body 200.

Figure 11:
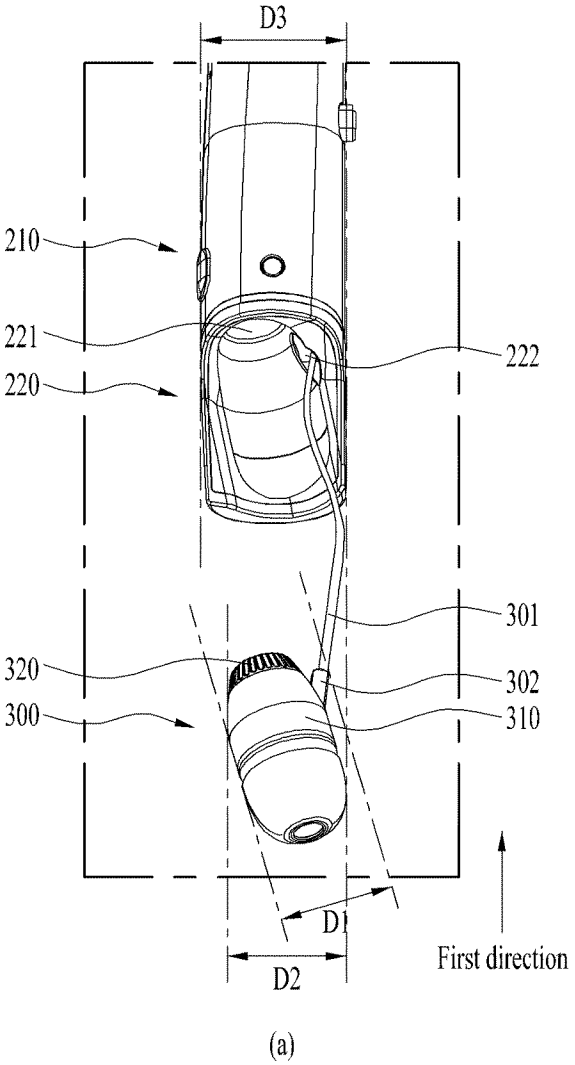
FIG. 11 is a view illustrating one area of the portable sound device according to the present invention.
Figure 11:
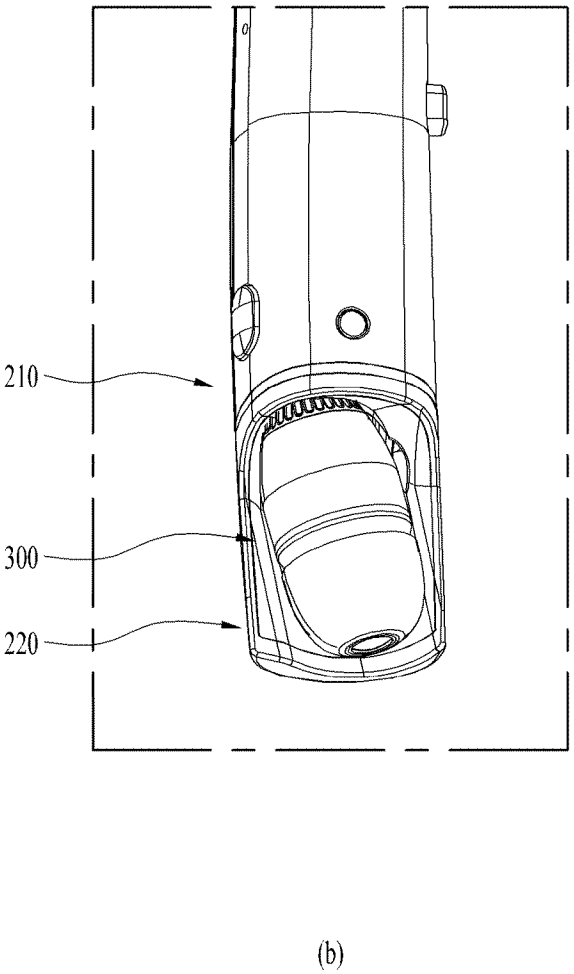

FIG. 11 is a view illustrating one area of the portable sound device 100 according to the present invention.

As described above, the ear unit 300 is selectively seated in the main body 200, more particularly, in the neck-band housing 210. The neck-band housing 210 have a first end configured to allow the ear unit wire 301. At the same time, the ear unit wire 301 of the ear unit 300 is introduced into or discharged from the neck-band housing 210.

The neck-band housing 210 includes a seating portion 220 for seating the ear unit 300 therein.

The seating portion 220 includes a seating surface 221, which is in contact with the ear unit 300 seated thereon. The seating surface 221 may be in contact with the rear surface of the ear unit 300, i.e. the rear surface of the rotator 320.

The seating portion 220 has therein a through-hole 222, through which the ear unit wire 301 of the ear unit 300 is introduced into or discharged from the electric part of the neck-band housing 210. In other words, the through-hole 222 allows the ear unit wire 301 to extend through the seating portion 220.

In the related art, since the unit wire 301 is provided on the rear of the ear unit 300, the ear unit 300 has not been formed to have a large width. Thus, the ear unit 300 is typically seated such that the longitudinal direction thereof is parallel to the longitudinal direction of the neck-band housing 210 (hereinafter, referred to as a first direction).

However, in the present invention, since the ear unit wire 301 is provided on the side surface of the ear unit 300, more particularly, the ear housing 310, the ear unit 300 has a larger width D1 than that in the related art. Thus, in the case where the ear unit 300 is seated such that the longitudinal direction thereof is parallel to the first direction, there is a risk of the width D3 of the neck-band housing 210 being excessively large. In addition, the angle between the direction in which the ear unit wire 310 is introduced into or discharged from the electric part of the neck-band housing 210 and the direction in which the ear unit wire 310 is discharged from the ear unit 300 may be large, which may deteriorate the durability of the ear unit wire 301.

To solve this problem, the ear unit 300 may be seated in the seating portion 220 such that the longitudinal direction of the ear unit 300 is tilted at a predetermined angle relative to the first direction of the neck-band housing 210. This means that the seating surface 221 is formed so as to be tilted relative to the first direction of the neck-band housing 210.

Since the width D2 of the ear unit 300 in the tilted state of the ear unit 300 is smaller than the width D1 of the ear unit 300 in the width direction, consequently, the neck-band housing 210 may have a small width D3. In addition, the ear unit wire 301 may be disposed so as to be parallel to or substantially parallel to the direction in which the ear unit wire 301 is discharged from the ear unit 300 and the direction in which the ear unit wire 301 is introduced into or discharged from the electric part of the neck-band housing 210, which may minimize deterioration in the durability of the ear unit wire 301.

Due to the fact that the ear unit wire 301 deviates to the side surface of the ear unit 300, the seating surface 221 and the through-hole 222 may be spaced apart from each other. That is, the seating surface 221 may be provided in a first area of the seating portion 220 and the through-hole 222 may be provided in a second area of the seating portion 220 so that that the seating surface 221 and the through-hole 222 are spaced apart from each other.

The width of the neck-band housing 210, more particularly, the width D3 of the seating portion 220, may be determined so as to sufficiently contain the width D2 of the ear unit 300 in the tilted state of the ear unit 300. Referring to both FIGS. 2 and 11, the seating portion 220 may be provided so as to surround, in particular, the entire upper portion of the ear unit 300. When the ear unit 300 is seated in the seating portion 220 of the neck-band housing 210, the ear unit 300 may be provided so as not to protrude when viewed from the upper surface of the portable sound device 100. This minimizes external shocks from being directly transmitted to the seated ear unit 300.

The seating portion 220 may surround a portion of the side surface of the ear unit 300 so as to protect the ear unit 300. However, the outer side surface of the seating portion 220 may be opened more than the inner side surface so as not to prevent attachment/detachment of the ear unit 300 to or from the seating portion 220.

However, the seating portion 220 may be formed so as to be opened without surrounding the lower portion of the ear unit 300, so as not to prevent attachment/detachment of the ear unit 300.

Figure 12:
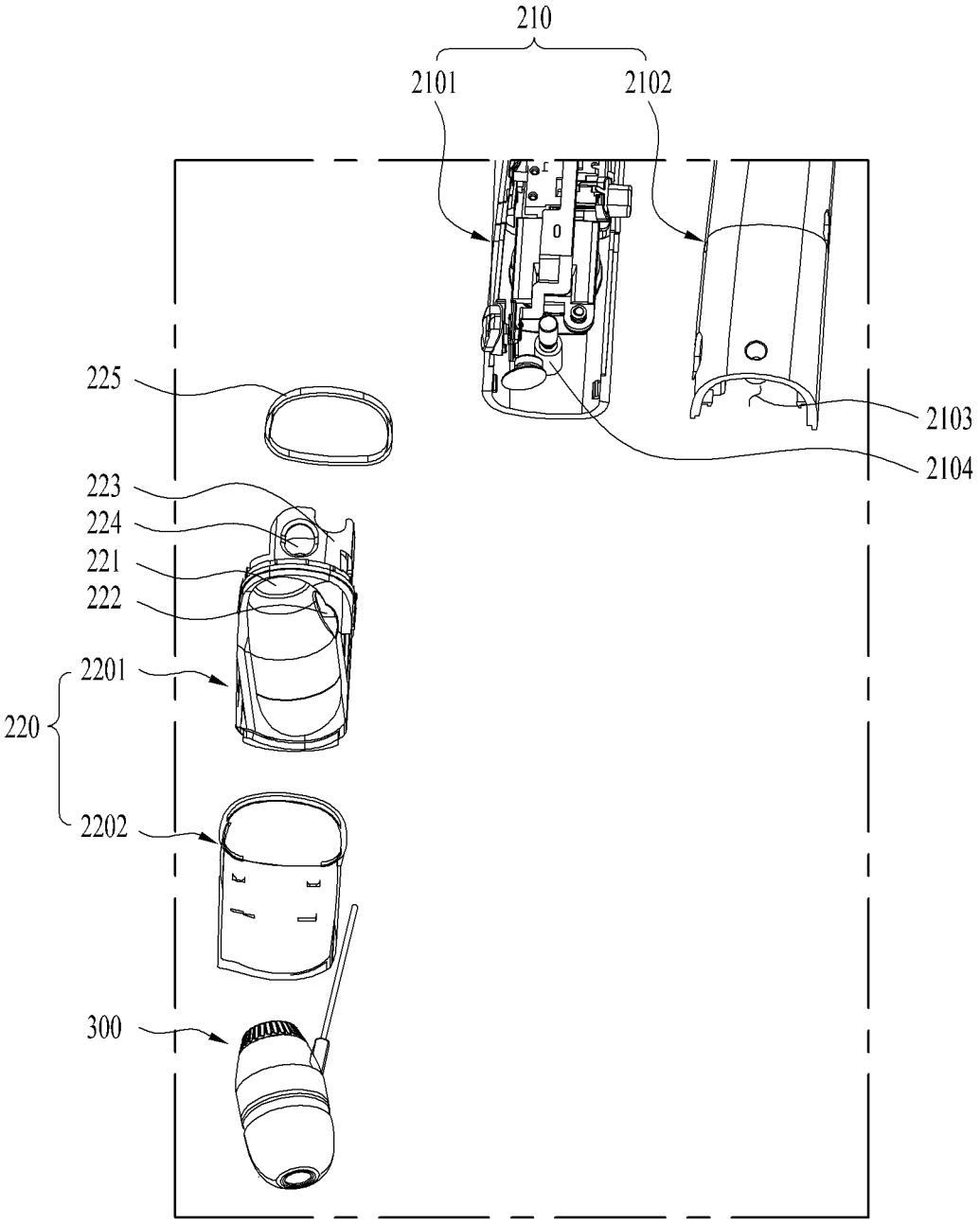
FIG. 12 is a partial exploded rear perspective view of the portable sound device according to the present invention.
Figure 13:
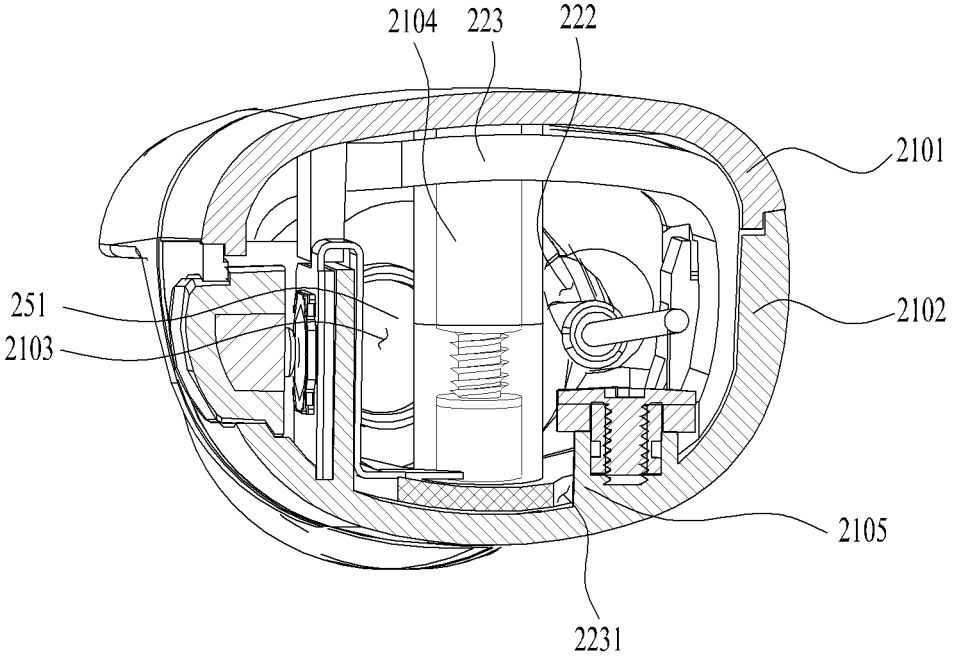
FIG. 13 is a cross-sectional view taken along line A-A' of FIG. 2.

FIG. 12 is a partial exploded rear perspective view of the portable sound device 100 according to the present invention. FIG. 13 is a cross-sectional view taken along line A-A' of FIG. 2. For convenience of description, FIGS. 12 and 13 are described together.

The neck-band housing 210, which defines the electric part, may be formed via the coupling of an upper housing 2101 and a lower housing 2102. The upper housing 2101 and the lower housing 2102, which are coupled to each other, may define an open area 2103 in one end thereof.

The seating portion 220, more particularly, a seating bracket 2201 of the seating portion 220, may be inserted into and coupled into the open area 2103 in the end of the neck-band housing 210.

The structure of separately coupling the seating bracket 2201 to the neck-hand housing 210 serves to prevent shocks applied to the seating portion 220 from being directly transmitted to the neck-band housing 210. In addition, through sectionalization of the main body 200, it is possible to enable independent replacement of respective areas.

A support portion 223 may support the upper surface, the lower surface, and one side surface of the neck-band housing 210 inside the open area 2103, thereby securing a sufficient support area through this three-sided supporting. This may prevent the seating bracket 2201 from moving relative to the neck-band housing 210 due to the generation of a gap therebetween.

The seating bracket 2201 may be further firmly fixed to the neck-band housing 210 through a support hole 224. A coupling boss 2104 may penetrate the support hole 224 so as to couple the upper portion and the lower portion of the neck-band housing 210.

The seating bracket 2201 may include an opening 2331 in the lower surface thereof so as not to interfere with a protrusion 2105, which is provided on the neck band housing 210. In some cases, the size of the opening 2331 may correspond to the size of the protrusion 2105 so as to allow the support portion 223 to support the protrusion 2105.

The seating surface 221 and the through-hole 222 described above may be provided in the seating bracket 2201. An upper-end cover 2202 may be coupled to the outer upper end of the seating bracket 2201 so as to define the exterior appearance of the upper end of the seating portion 220. As necessary, a decorative ring 225 may be fitted and coupled between the neck-band housing 210 and the seating bracket 2201.

A first magnetic element 251 may be provided inside the seating surface 221 in order to guide seating of the ear unit 300. Referring additionally to FIG. 9, a second magnetic element 325 may be mounted in the ear unit 300 so as to generate magnetic attraction with the first magnetic element 251. Particularly, the second magnetic element 325 may be provided in the rotation axis center of the rotator 320. This serves to prevent a change in the relative positions of the second magnetic element 325 and the first magnetic element 251 despite rotation of the rotator 320.

Figure 14:
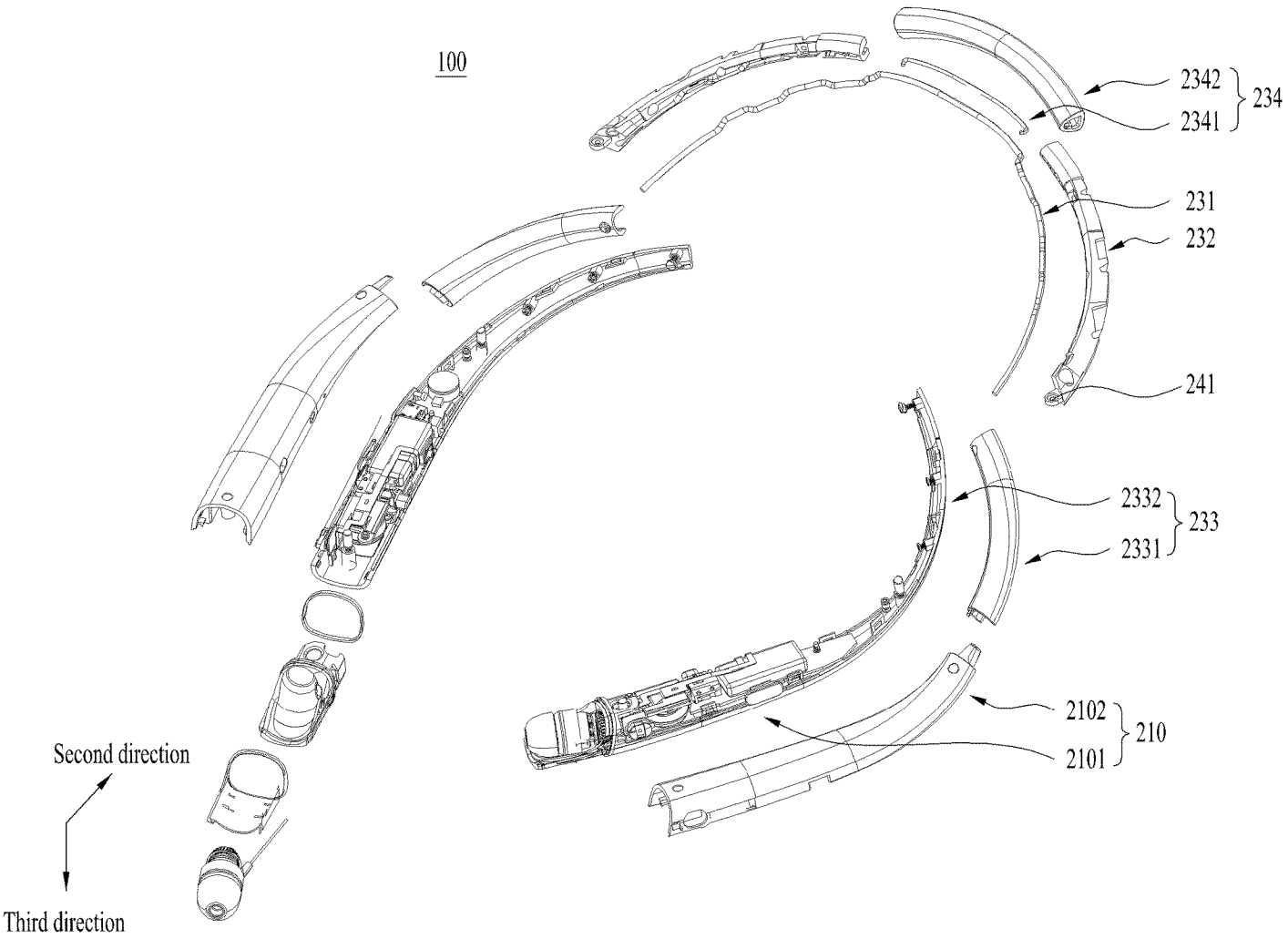
FIG. 14 is a rear exploded perspective view of the portable sound device according to the present invention.

FIG. 14 is a rear exploded perspective view of the portable sound device 100 according to the present invention.

A conducting wire 231 electrically interconnects electronic elements of both the neck-band housings 210. The conducting wire 231 is fixed by a wire bracket 232 so as to keep the shape thereof. A wire case 233 surrounds the wire bracket 232 and defines a portion of the exterior appearance of the portable sound device 100.

The wire case 233 may include an inner wire case 2331, which faces the inner side of a curved portion of the portable sound device 100, and an outer wire case 2332, which faces the outer side of the curved portion. The inner wire case 2331 and the outer wire case 2332 may be coupled and fixed to each other.

The wire bracket 232 may include a bellows-shaped portion 241 to be fixed to each neck-band housing 210, and the inner wire case 2331 surrounds the wire bracket 232 so that the bellows-shaped portion 241 is exposed.

An elastic wire portion 234 refers to an area that interconnects both the neck-band housings 210 or both the wire cases 233. The elastic wire portion 234 may have elasticity and thus be bendable. The elastic wire portion 234 includes an elastic wire 2341 and an elastic wire tube 2342.

The elastic wire 2341 may have a property by which, even if it is deformed by a predetermined force, it returns to its original shape when the force is removed. In one example, the elastic wire 2341 may be formed of a shape memory alloy.

The elastic wire tube 2342 defines a portion of the exterior appearance of the portable sound device 100 and forms a hollow region in which the elastic wire 2341 and the conducting wire 231 may be mounted. The elastic wire tube 2342 may be formed of an elastic material and may be deformed and then returned along with the elastic wire 2341.

The elastic wire portion 234 may correspond to the back of the neck when the portable sound device 100 is worn around the user's neck.

Figure 15:
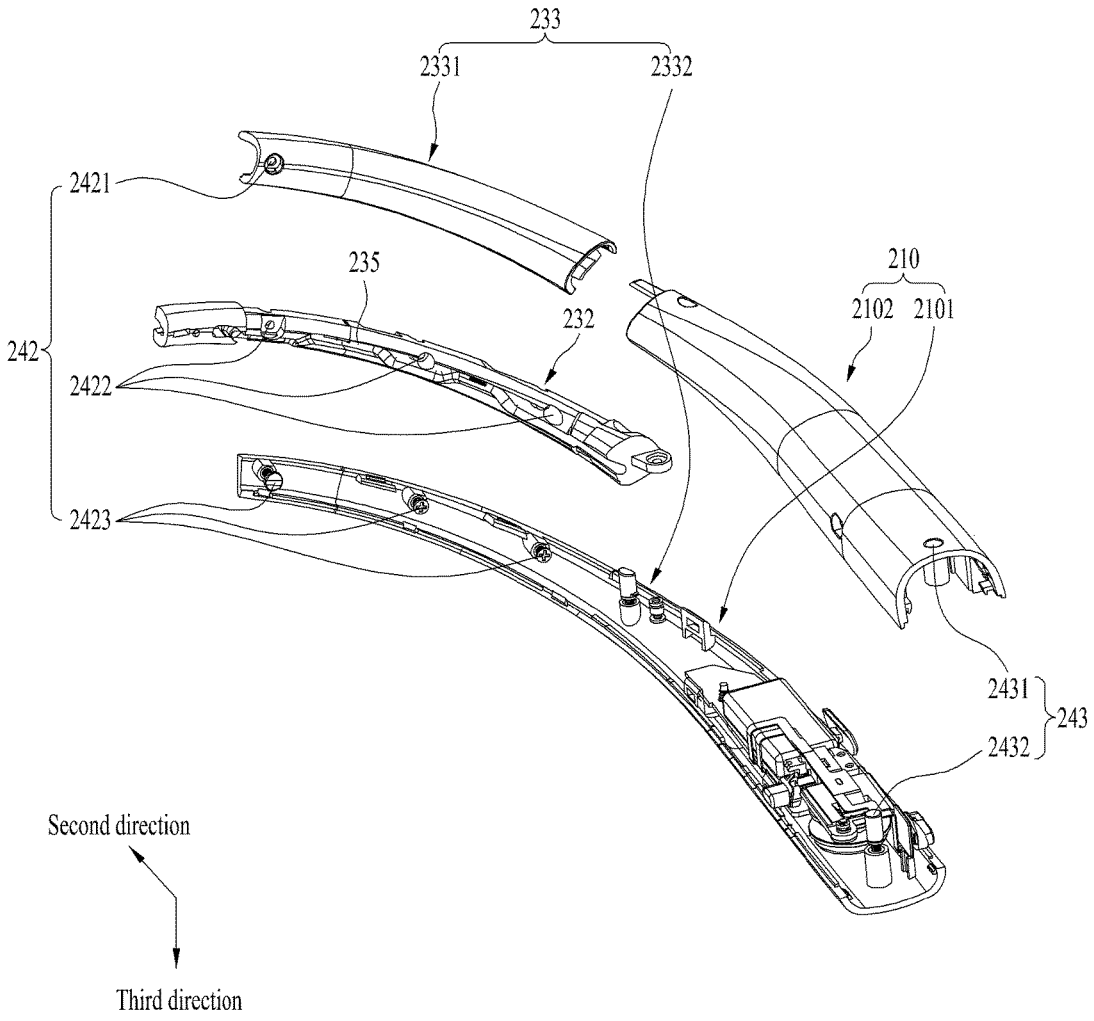
FIG. 15 is a partial rear perspective view of the portable sound device according to the present invention.

FIG. 15 is a partial rear perspective view of the portable sound device 100 according to the present invention.

The inner wire case 2331 and the outer wire case 2332 may be stacked one above another in a second direction, and may be coupled to each other. The second direction may refer to the direction from the inner side to the outer side of the curved portion of the portable sound device 100. The inner wire case 2331 may have a curved surface, the inclination of which gradually varies from the plane orthogonal to the second direction to the plane orthogonal to a third direction. The area having this curved surface may be in natural contact with the user's neck and may maximally prevent the boundary between the inner wire case 2331 and the outer wire case 2332 from coming into contact with the user's neck, causing discomfort.

The third direction may refer to the direction from the lower surface toward the upper surface of the portable sound device 100.

The upper housing 2101 and the lower housing 2102 of the neck-band housing 210, which define the electric part, may be stacked in the third direction. When all of the upper housing 2101, the lower housing 2102, and a main board are stacked in the third direction, stable arrangement of electronic elements may be achieved, and the assembly process may be convenient.

A first screw is used to fix the inner wire case 2331, the wire bracket 232, and the outer wire case 2332. A first screw hole 242 forms relative surfaces to which the first screw is fixed. On the other hand, a second screw is used to fix the lower housing 2102 and the upper housing 2101 of the neck-band housing 210. A second screw hole 243 forms relative surfaces to which the second screw is fixed.

The first screw hole 242 may be formed in the second direction in consideration of the direction in which the inner wire case 2331 and the outer wire case 2332 are stacked. On the other hand, the second screw hole 243 may be formed in the third direction in consideration of the direction in which the lower housing 2102 and the upper housing 2101 of the neck-band housing 210 are stacked.

The first screw hole 242 in the inner wire case 2331 and the second screw hole 243 in the lower housing 2102 of the neck-band housing 210 may be formed respectively to penetrate the inner wire case 2331 and the lower housing 2102.

Since the first screw hole 242 and the second screw hole 243 face different directions from each other, the inner wire case 2331 and the lower housing 2102 of the neck-band housing 210 may be manufactured separately. That is, the inner wire case 2331 and the lower housing 2102 of the neck-band housing 210 may be injection-molded using molds, and the orientations of the molds need to be different because of the screw holes. Therefore, the inner wire case 2331 and the lower housing 2102 of the neck-band housing 210 may be manufactured separately.

On the other hand, since the outer wire case 2332 and the upper housing 2101 are not configured so that the first and second screw holes penetrate the same, the orientations of the screw holes are independent of the orientations of the molds. Thus, the outer wire case 2332 and the upper housing 2101 may be integrally manufactured.

A plurality of first screws, more particularly, three screws may be provided so as to further firmly fasten the wire bracket 232 and the outer wire case 2332 to each other.

However, only one first screw among the plurality of first screws may be fastened to the inner wire case 2331. This is because the inner wire case 2331 is configured so as to be in contact with the user's neck as described above, and therefore it is necessary to minimize the area in which the screw is exposed.

The wire bracket 232 may have therein a wire seating groove 235 in which the conducting wire 231 is seated, in order to minimize movement of the conducting wire 231. The wire seating groove 235 may form a curved area configured to avoid the first screw hole 242.

In addition, the wire seating groove 235 having the bent area may maximize the area of a seated surface of the conducting wire 231 when the conducting wire 231 is seated so as to further firmly fix the conducting wire 231, which may prevent short-circuiting of the conducting wire 231 due to tension in the longitudinal direction. The seating groove 235 includes a plurality of bent portions to deviate to one side of each of the plurality of the first screw holes 242 in the corresponding wire cases 233.

Figure 16:
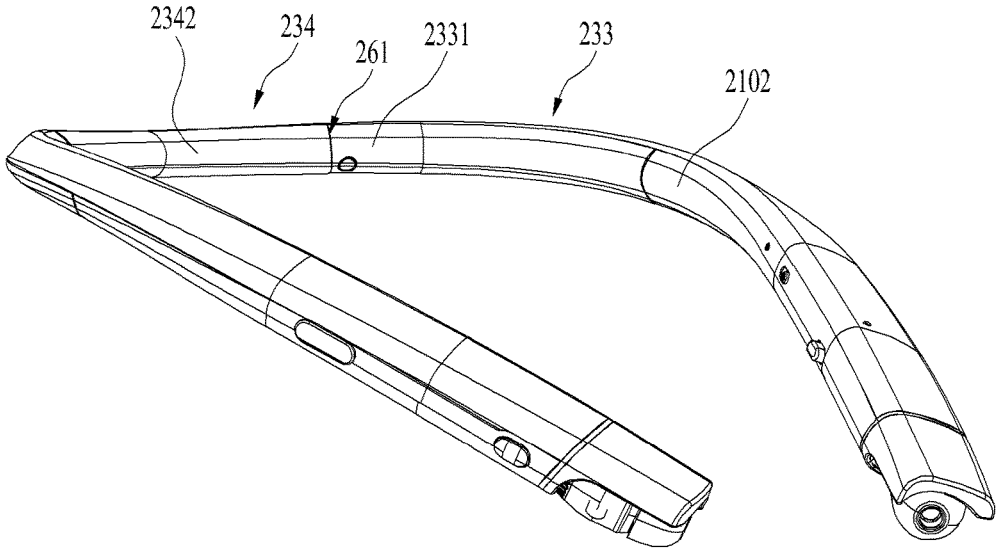
FIG. 16 is a view illustrating one area of the portable sound device according to the present invention, which is viewed from the inner side toward the outer side.

FIG. 16 is a view illustrating one area of the portable sound device 100 according to the present invention, which is viewed from the inner side toward the outer side.

The following description is based on the coupling form described with reference to FIG. 14. The outer surface of the elastic wire portion 234, more particularly, the elastic wire tube 2342 forms a continuous surface along with the outer surface of the wire case 233. This serves to prevent uncomfortable wearing sensation when it is seated on the user's neck. Particularly, a boundary 261 between the elastic wire portion 234 and the inner wire case 2331 is an area having a high probability of being in contact with the user's neck, and thus may form a continuous surface with increased accuracy.

In addition, the boundary 261 between the elastic wire portion 234 and the wire case 233 may have a curved line in an arbitrary direction. The arbitrary direction refers to any of all directions that are arbitrarily designated, and the boundary 261 may be configured so as not to have a straight line when viewed from any direction. A boundary having a curved shape may prevent the user's hair from becoming stuck in a boundary gap.

Particularly, the boundary between the elastic wire portion 234 and the wire case 233 may have an S-shaped form. The boundary having an S-shaped form may minimize a straight line area and thus may further reduce the probability of hair being stuck in the gap.

It will be apparent to those skilled in the art that the present invention may be embodied into other particular forms without departing from the spirit and essential features of the present invention.

The above detailed description should not be construed to be limited in all terms, but should be considered as being illustrative. The scope of the present invention should be determined by the reasonable interpretation of the accompanying claims, and all changes within the equivalent range of the present invention are included in the scope of the present invention.

The effects of an ear unit and a portable sound device according to the present invention will be described as follows.

According to at least one of the embodiments of the present invention, it is possible to output sound by selecting from among a plurality of equalizing effects.

In addition, according to at least one of the embodiments of the present invention, it is possible to output flat sound having a reduced output within a low pitch range.

In addition, according to at least one of the embodiments of the present invention, it is possible to minimize noise, which may occur when selectively performing any one of a plurality of equalizing effects.

In addition, according to at least one of the embodiments of the present invention, it is possible to increase the reliability of coupling between a rotator and an ear housing.

In addition, according to at least one of the embodiments of the present invention, it is possible to reliably recognize the rotation of the rotator for realizing one of a plurality of equalizing effects.

In addition, according to at least one of the embodiments of the present invention, it is possible to realize trouble-free switching between a bass boost equalizing effect and a flat equalizing effect.

In addition, according to at least one of the embodiments of the present invention, it is possible to minimize the possibility of damage to an ear unit wire, which is coupled to the ear unit.

In addition, according to at least one of the embodiments of the present invention, it is possible to minimize the influence of external shocks when the ear unit is seated in a neck-band housing.

In addition, according to at least one of the embodiments of the present invention, it is possible to alleviate shocks applied to the end of the neck-band housing.

In addition, according to at least one of the embodiments of the present invention, it is possible to optimize the process of manufacturing the neck-band housing.

In addition, according to at least one of the embodiments of the present invention, it is possible to improve the wearing sensation of the neck-band housing.

In addition, according to at least one of the embodiments of the present invention, it is possible to minimize jamming of hairs in the neck-band housing.

The additional range of possible application of the present invention will become apparent from the following detailed description. However, since various changes and modifications within the scope and spirit of the present invention will be clearly understood by those skilled in the art, it should be understood that a detailed description and particular embodiments such as exemplary embodiments of the present invention are merely given by way of example.

What is claimed is:

1. An ear unit comprising:

an ear housing including a bass hole and a flat hole formed in a rear surface of the ear housing, the bass hole being larger than the flat hole;

a driver unit mounted in the ear housing; and a rotator rotatably coupled to the ear housing, the rotator including an inner bracket opposite the rear surface of the ear housing, the inner bracket having an opening/closing hole configured to open or close the bass hole or the flat hole according to a rotational position of the rotator, wherein the ear housing further includes:

an inner case having a damper layer and an inner hole formed at the damper layer;

an outer case coupled to an outer surface of the inner case, the outer case having a hole plate, and the bass hole and the flat hole are formed at the hole plate; and a duct groove formed in an inner surface of the hole plate so as to connect the inner hole and the flat hole.

2. The ear unit according to claim 1, further comprising a sealing gasket provided between the rear surface of the housing and the inner bracket of the rotator, the sealing gasket including connection holes corresponding to the bass hole and the flat hole, respectively.

3. The ear unit according to claim 1, wherein the ear housing includes a coupling flange defined by a circular opening, the circular opening having an inner circumferential surface, and wherein the rotator includes a rotating hook portion configured to be fastened to the coupling flange so as to rotate along the inner circumferential surface of the circular opening.

4. The ear unit according to claim 3, wherein the rotating hook portion includes a plurality of hook protrusions extending from the inner bracket towards the rear surface, the plurality of hook protrusions being spaced about the inner circumferential surface of the circular opening.

5. The ear unit according to claim 4, wherein the rotating hook portion includes a rubber support element fitted between the hook protrusions of the plurality of hook protrusions to press the hook protrusions towards the inner circumferential surface of the circular opening.

6. The ear unit according to claim 1, further comprising a guide portion provided between the ear housing and the rotator to limit a rotation angle of the rotator between a first positon at a first end of the rotation angle and a second position at a second end of the rotation angle, wherein the opening/closing hole opens an overall area of the bass hole in the first position in which the rotator is rotated to the first end of the rotation angle, and wherein the opening/closing hole opens an overall area of the flat hole in the second position in which the rotator is rotated to the second end of the rotation angle.

7. The ear unit according to claim 6, wherein the rotator is rotatable through a third position between the first position and the second position in which the opening/closing hole opens a partial area of the bass hole and a partial area of the flat hole simultaneously.

8. The ear unit according to claim 1, wherein the hole plate includes a groove formed in the inner surface of the hole plate so as to connect the inner hole and the flat hole.

9. The ear unit according to claim 1, further comprising a ventilation mesh at the opening/closing hole.

10. A portable sound device comprising:

an ear unit including an ear housing in which a driver is mounted and a rotator rotatably coupled to a rear surface of the ear housing;

an ear unit wire comprising one end coupled to a side surface of the ear housing;

a neck-band housing extending in a longitudinal direction, the neck-band housing having a first end configured to allow the ear unit wire to be introduced into or discharged from the neck-band housing; and a seating portion formed at the first end of the neck-band housing and surrounding an entire upper portion of the ear unit, the seating portion including:

a seating surface tilted at a predetermined angle relative to the longitudinal direction and contacting with a rear portion of the ear unit; and a through hole configured to allow the ear unit wire to extend through the seating portion, wherein the ear unit, the ear wire unit, and the neck-band housing are provided in pairs, wherein the portable sound device further includes:

a conducting wire configured to electrically interconnect the pair of neck-band housings;

a pair of wire brackets configured to support the conducting wire, each wire bracket being connected at a first end to a corresponding neck-band housing of the pair of neck-band housings; and a pair of wire cases, each wire case being configured to surround a corresponding wire bracket of the pair of wire brackets so as to define an external appearance of the portable sound device, each wire case including a plurality of first screw holes configured to enable fastening between the wire case and the corresponding wire bracket, and wherein the first screw holes are provided in each of three positions including the first end, a middle portion, and another portion adjacent the middle portion of the corresponding wire bracket.

11. The portable sound device according to claim 10, wherein the seating surface is provided on a first area of the seating portion, wherein the through hole is provided on a second area of the seating portion, and wherein the first area and the second area are spaced apart from each other.

12. The portable sound device according to claim 10, wherein the first end of the neck-band housing includes an open area, and wherein the seating portion further includes a seating bracket inserted into and coupled to the open area of the neck-band housing.

13. The portable sound device according to claim 12, wherein the seating bracket includes a support portion configured to support an upper surface, a lower surface, and a side surface of the neck-band housing from inside the open area, the support portion including a support hole to receive a coupling boss that couples an upper portion of the neck-band housing to a lower portion of the neck-band housing.

14. The portable sound device according to claim 10, further comprising a wire seating groove formed in the wire bracket so that the conducting wire is seated therein, wherein the wire seating groove comprises an area corresponding to the first screw hole and having a bent shape so as to deviate to one side.

15. The portable sound device according to claim 10, wherein the wire case comprises:

an inner wire case configured to surround one surface of the wire bracket;

an outer wire case coupled to the inner wire case and configured to surround a remaining surface of the wire bracket; and the first screw hole formed in the inner wire case in a second direction, wherein the neck-band housing comprises:

an upper neck-band housing;

a lower neck-band housing coupled to the upper neck-band housing; and a second screw hole formed in the lower neck-band housing in a third direction, and wherein the second direction and the third direction are different directions, the outer wire case and the upper neck-band housing are integrally manufactured, and the inner wire case and the lower neck-band housing are manufactured separately.

16. The portable sound device according to claim 10, further comprising an elastic wire portion comprising opposite ends each connected to the wire bracket, the elastic wire portion being configured to form a continuous surface along with the wire case so as to define an external appearance, wherein a boundary between the elastic wire portion and the wire case comprises a curved area in an arbitrary direction.

17. The portable sound device according to claim 16, wherein the boundary between the elastic wire portion and the wire case has an "S" shape.

18. The portable sound device according to claim 10, further comprising:

a first magnetic element provided inside the seating surface; and a second magnetic element provided along a rotational center axis of the rotator in the ear unit, the second magnetic element configured to generate magnetic attraction with the first magnetic element.

* * * * *